US007001251B2

(12) United States Patent
Doan et al.

(10) Patent No.: US 7,001,251 B2
(45) Date of Patent: Feb. 21, 2006

(54) METHOD AND APPARATUS FOR RELEASABLY ATTACHING A POLISHING PAD TO A CHEMICAL-MECHANICAL PLANARIZATION MACHINE

(75) Inventors: Trung Tri Doan, Boise, ID (US); Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 72 days.

(21) Appl. No.: 09/928,173

(22) Filed: Aug. 9, 2001

(65) Prior Publication Data

US 2002/0045407 A1 Apr. 18, 2002

Related U.S. Application Data

(62) Division of application No. 09/539,854, filed on Mar. 31, 2000, now Pat. No. 6,482,077, which is a division of application No. 09/181,578, filed on Oct. 28, 1998, now Pat. No. 6,602,380.

(51) Int. Cl.
*B24B 1/00* (2006.01)

(52) U.S. Cl. ..... 451/41; 451/494

(58) Field of Classification Search ..... 457/494, 457/41, 286, 287, 288, 289; 451/28
See application file for complete search history.

(56) References Cited

U.S. PATENT DOCUMENTS 5,103,367 A * 4/1992 Horwitz et al. ..... 361/234
5,265,381 A 11/1993 Takahashi ..... 51/283 R
5,325,261 A * 6/1994 Horwitz ..... 361/234
5,461,907 A * 10/1995 Tench et al. ..... 73/105
5,464,361 A 11/1995 Suzuki et al. ..... 451/28
5,531,861 A 7/1996 Yu et al. ..... 156/636.1
5,593,344 A 1/1997 Weldon et al. ..... 451/296
5,605,487 A 2/1997 Hileman et al. ..... 451/5
5,660,581 A 8/1997 Shin et al. ..... 451/289
5,704,827 A 1/1998 Nishi et al. ..... 451/285
5,720,845 A 2/1998 Liu ..... 156/345
5,782,675 A 7/1998 Southwick ..... 451/56
5,882,417 A 3/1999 Van de Ven et al. ..... 118/728
5,895,270 A 4/1999 Hempel, Jr. ..... 438/692
5,899,801 A 5/1999 Tolles et al. ..... 451/288
5,908,530 A 6/1999 Hoshizaki et al. ..... 156/345
5,921,852 A 7/1999 Kimura et al. ..... 451/285

(Continued)

*Primary Examiner*—Eileen P. Morgan
(74) *Attorney, Agent, or Firm*—Dorsey & Whitney LLP

(57) ABSTRACT

A method and apparatus for releasably attaching a planarizing medium, such as a polishing pad, to the platen of a chemical-mechanical planarization machine. In one embodiment, the apparatus can include several apertures in the upper surface of the platen that are coupled to a vacuum source. When a vacuum is drawn through the apertures in the platen, the polishing pad is drawn tightly against the platen and may therefore be less likely to wrinkle when a semiconductor substrate is engaged with the polishing pad during planarization. When the vacuum is released, the polishing pad can be easily separated from the platen. The apparatus can further include a liquid trap to separate liquid from the fluid drawn by the vacuum source through the apertures, and can also include a releasable stop to prevent the polishing pad from separating from the platen should the vacuum source be deactivated while the platen is in motion. In another embodiment, a signal can be applied to the platen to draw the polishing pad toward the platen via electrostatic or electromagnetic forces. In still another embodiment, the polishing pad can be attached to a pad support and conditioned on a separate jig.

13 Claims, 10 Drawing Sheets

U.S. PATENT DOCUMENTS 5,961,378 A 10/1999 Inaba ..... 451/259
6,059,638 A * 5/2000 Crevasse et al. ..... 451/41
6,083,083 A 7/2000 Nishimura ..... 451/41
6,244,941 B1 * 6/2001 Bowman et al. ..... 451/494
6,244,944 B1 6/2001 Elledge ..... 451/296
6,261,958 B1 * 7/2001 Crevasse et al. ..... 451/494

* cited by examiner

METHOD AND APPARATUS FOR RELEASABLY ATTACHING A POLISHING PAD TO A CHEMICAL-MECHANICAL PLANARIZATION MACHINE

CROSS-REFERENCE TO RELATED APPLICATIONS

This application is a divisional of U.S. patent application Ser. No. 09/539,854, filed Mar. 31, 2000 now U.S. Pat. No. 6,482,077, which is a divisional on U.S. patent application Ser. No. 09/181,578, filed Oct. 28, 1998 now U.S. Pat. No. 6,602,380.

TECHNICAL FIELD

The present invention relates to methods and devices for releasably attaching polishing pads to the platens of chemical-mechanical planarization machines.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 60, a polishing pad 40, and a planarizing liquid 41 on the polishing pad 40. The polishing pad 40 may be a conventional polishing pad made from a continuous phase matrix material (e.g., polyurethane), or it may be a fixed abrasive polishing pad made from abrasive particles fixedly dispersed in a suspension medium. The planarizing liquid 41 may be a conventional CMP slurry with abrasive particles and chemicals that etch and/or oxidize the wafer, or the planarizing liquid 41 may be a planarizing solution without abrasive particles that contains only chemicals to etch and/or oxidize the surface of the wafer. In most CMP applications, conventional CMP slurries are used on conventional polishing pads, and planarizing solutions without abrasive particles are used on fixed abrasive polishing pads.

The CMP machine 10 also has an underpad 25 attached to an upper surface 30 of the platen 20 and the lower surface of the polishing pad 40. In one type of CMP machine, a drive assembly 50 rotates the platen 20 as indicated by arrow A. In another type of CMP machine, the drive assembly reciprocates the platen back and forth as indicated by arrow B. Since the polishing pad 40 is attached to the underpad 25, the polishing pad 40 moves with the platen 20.

The wafer carrier 60 has a lower surface 63 to which a wafer 12 may be attached, or the wafer 12 may be attached to a resilient pad 64 positioned between the wafer 12 and the lower surface 63. The wafer carrier 60 may be a weighted, free-floating wafer carrier, or an actuator assembly 61 may be attached to the wafer carrier to impart axial and/or rotational motion (indicated by arrows C and D, respectively).

To planarize the wafer 12 with the CMP machine 10, the wafer carrier 60 presses the wafer 12 face-downward against the polishing pad 40. While the face of the wafer 12 presses against the polishing pad 40, at least one of the platen 20 or the wafer carrier 60 moves relative to the other to move the wafer 12 across the planarizing surface 42. As the face of the wafer 12 moves across the planarizing surface 42, the polishing pad 40 and the planarizing liquid 41 continually remove material from the face of the wafer 12.

CMP processes must consistently and accurately produce a uniform, planar surface on the wafer to enable precise circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns of such small tolerances, however, is difficult when the planarized surface of the wafer is not uniformly planar. Thus, CMP processes must create a highly uniform, planar surface.

One problem with conventional CMP processing techniques is that the planarized surface of the wafer may not be sufficiently uniform due to nonuniformities that may develop in the planarizing surface of the polishing pad during planarization. One conventional approach to addressing this problem is to firmly attach the polishing pad to the platen to decrease the likelihood that the polishing pad will warp or wrinkle as the wafer carrier and substrate move across the planarizing surface. For example, in one conventional approach, the polishing pad may be attached to the platen with a high-strength adhesive. One drawback with this approach is that the planarizing surface of the polishing pad typically wears out during normal use and the polishing pad must therefore be replaced. It may be difficult and time consuming to remove the polishing pad and the high-strength adhesive from the platen, rendering the CMP machine inoperable for extended periods of time.

One conventional approach to addressing the foregoing problem is to manufacture a sheet of polishing pad material and stretch it across the platen from one side to the other. As the polishing pad wears, it is incrementally moved across the platen in the manner of a conveyor belt to present an unworn planarizing surface to the wafer. Such a device is manufactured by Obsidian, Inc. of Fremont, Calif. One problem with this approach is that the tension in the sheet may not be sufficient to keep it flat against the platen. Accordingly, the sheet may tend to wrinkle or fold upon itself under the pressure exerted by the wafer carrier and the wafer.

SUMMARY OF THE INVENTION

The present invention is directed toward a method and apparatus for releasably attaching a planarizing medium to a chemical-mechanical planarization machine. The apparatus can comprise a support and a platen having an engaging surface with one or more vacuum apertures sized and shaped to be coupled to a vacuum source. A planarizing medium can be tightly drawn against the engaging surface of the platen when the vacuum source applies a vacuum to the vacuum apertures. The planarizing medium can include a polishing pad having a generally non-porous surface that seals against the engaging surface of the platen. Alternatively, the planarizing medium can include a porous polishing pad adhesively attached to a pad support. The pad support may have a generally non-porous surface opposite the polishing pad that seals against the platen when the vacuum source is activated. In yet another alternative aspect of the invention, the polishing pad and the pad support can be supported, for example, in a support jig, to condition the polishing pad. In still another alternative aspect of the invention, a signal can be applied to the platen to attract the polishing pad toward the platen via electrostatic or electromagnetic forces.

The platen may be movable relative to the support and may include a lip to prevent the planarizing medium from separating from the platen if the vacuum source is deactivated while the platen is still in motion. The platen may also include a releasable stop to further engage the planarizing medium. Alternatively, the platen may be replaced by a base that is fixed relative to the support and the apparatus may further include a supply device and a take-up device that advance an elongated planarizing medium across the base. During planarization, the vacuum source draws the planarizing medium against the base. When the planarizing medium becomes worn (or for other reasons), the vacuum source or charge source may be deactivated and the planarizing medium may be advanced across the base to expose a different portion of the planarizing medium to the semiconductor substrate.

DETAILED DESCRIPTION OF THE INVENTION

The present invention is directed toward methods and devices for attaching a polishing pad to a platen of a chemical-mechanical planarization machine. The device may include a vacuum system that releasably attaches the polishing pad to the platen such that the polishing pad may be easily removed and/or replaced, or may be incrementally advanced over the platen. Many specific details of certain embodiments of the invention are set forth in the following description and in FIGS. 2–7 to provide a thorough understanding of such embodiments. One skilled in the art, however, will understand that the present invention may have additional embodiments and that they may be practiced without several of the details described in the following description.

Figure 1:
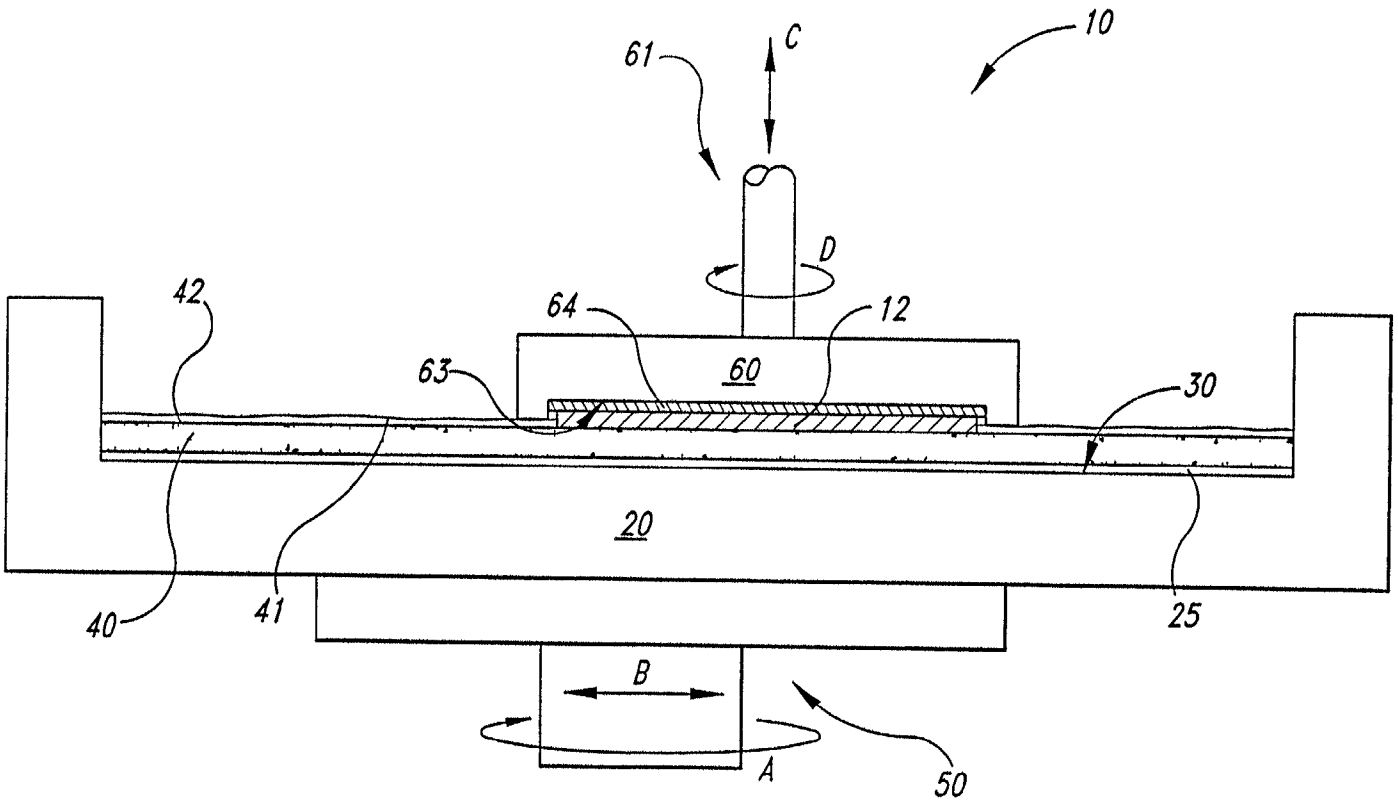
Fig. 1 (Prior Art)
FIG. 1 is a partial cross-sectional elevation view of a chemical-mechanical planarization machine in accordance with the prior art.
Figure 2:
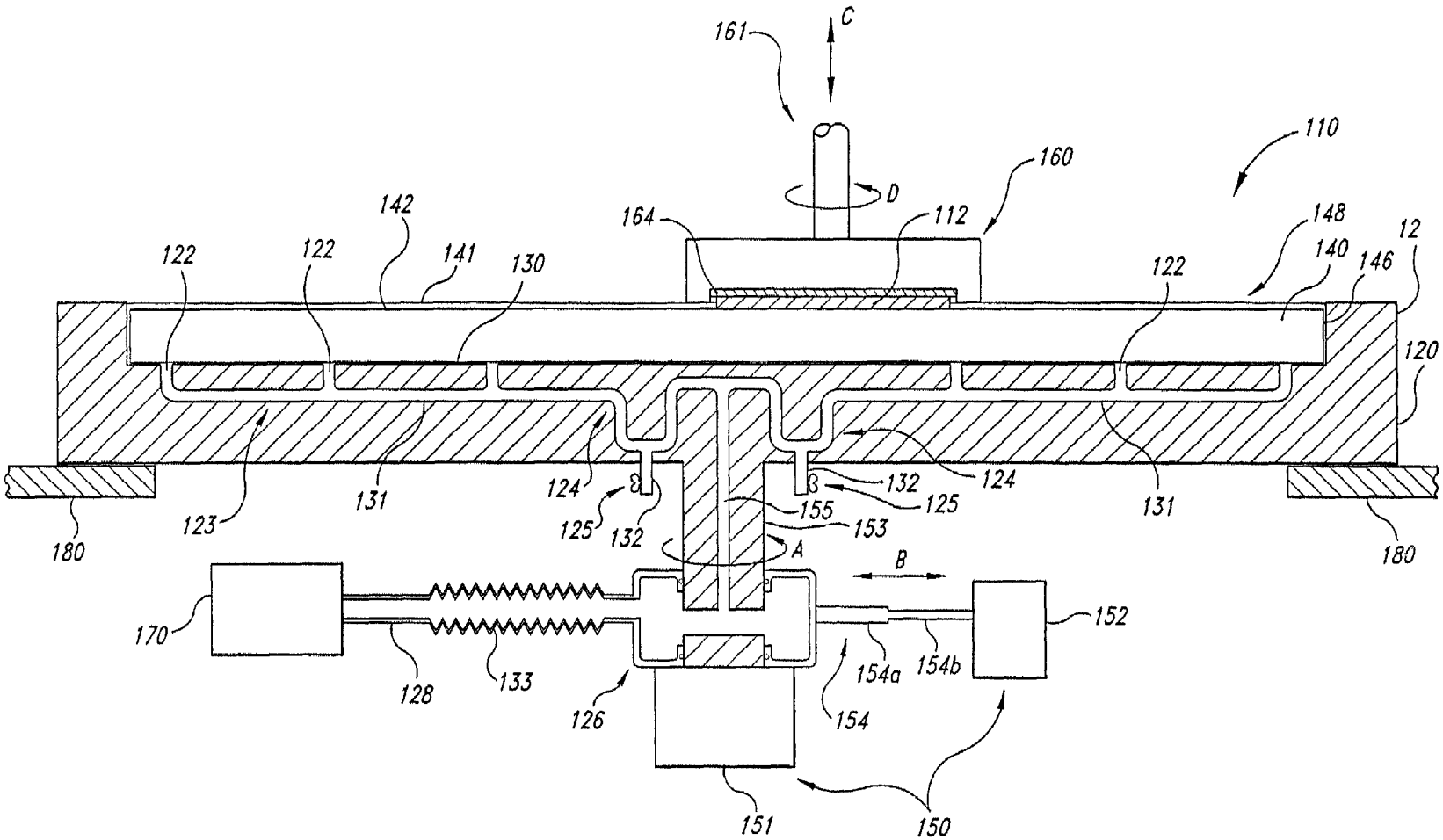
FIG. 2 is a partial cross-sectional elevation view of an apparatus having a platen with vacuum apertures in accordance with an embodiment of the present invention.

FIG. 2 illustrates a CMP apparatus 110 having a platen 120 and a planarizing medium 148. In the embodiment shown in FIG. 2, the planarizing medium 148 includes polishing pad 140 releasably attached to the platen 120, and in other embodiments, the planarizing medium 148 may include other components, as is discussed in greater detail below with reference to FIG. 5. The platen 120 may be movable relative to a support structure 180 by means of a platen drive assembly 150 that may impart rotational motion (indicated by arrow A) and/or translational motion (indicated by arrow B) to the platen 120. As was discussed above, the CMP apparatus 110 may also include a carrier assembly 160 having a resilient pad 164 that presses a semiconductor substrate 112 against a planarizing surface 142 of the polishing pad 140. A carrier drive assembly 161 may be coupled to the carrier assembly 160 to move the carrier assembly axially (indicated by arrow C) and/or rotationally (indicated by arrow D) relative to the platen 120.

The platen 120 has an upper surface 130 adjacent the polishing pad 140. The upper surface 130 includes a plurality of vacuum apertures 122 that are in fluid communication with a vacuum passageway 123. The vacuum passageway 123 is coupled to a vacuum source 170, as will be discussed in greater detail below, such that when the vacuum source 170 is activated, it draws a vacuum through the vacuum apertures 122 and draws the polishing pad 140 tightly against the upper surface 130 of the platen 120.

Figure 3:
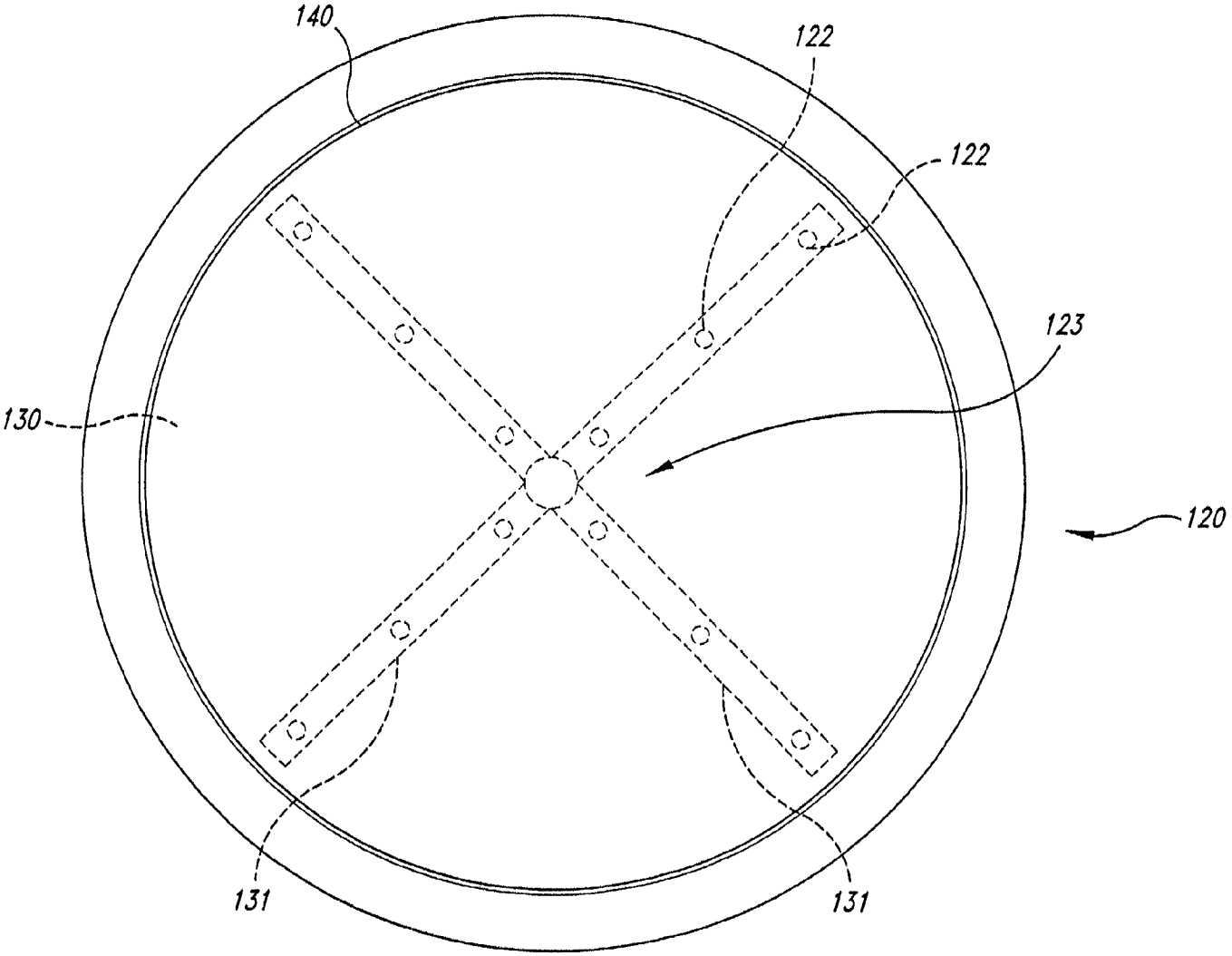
FIG. 3 is a top plan view of the platen shown in FIG. 2.

FIG. 3 is a top plan view of the platen 120 and the polishing pad 140 shown in FIG. 2. Referring to FIGS. 2 and 3, the vacuum apertures 122 of the platen 120 may have a circular cross-sectional shape at the platen upper surface 130 and may have other shapes in other embodiments, as will be discussed below with reference to FIG. 4. The platen 120 may have twelve vacuum apertures 122, as shown in FIGS. 2 and 3, and may have a greater or lesser number of vacuum apertures 122 in other embodiments, so long as the force exerted by the vacuum source 170 (FIG. 2) through the vacuum apertures 122 is sufficient to secure the polishing pad 140 to the platen 120. In one embodiment, the vacuum source 170 may generate a vacuum pressure of 10 $lb/in^2$ ($6.9\times10^4$ $N/m^2$) below atmospheric pressure, measured at the vacuum apertures 122. In other embodiments, the vacuum source 170 may generate other pressures sufficient to secure the polishing pad 140 to the platen 120, depending on the characteristics of the polishing pad 140 and the size, shape, and number of the vacuum apertures 122.

The vacuum apertures 122 extend downwardly through the platen upper surface 130 to the vacuum passageway 123 below. In the embodiment shown in FIGS. 2 and 3, the vacuum passageway 123 may have a plurality of radially extending arms 131 that meet near the center of the platen 120. In other embodiments, the vacuum passageway 123 may have other configurations that provide fluid communication between the vacuum apertures 122 and the vacuum source 170.

As shown in FIG. 2, each arm 131 of the vacuum passageway 123 may have a liquid trap 124 to separate liquid from the fluid stream that passes through the vacuum passageway 123 when the vacuum source 170 is activated. The fluid stream may include air or other gases adjacent the planarizing surface 142, as well as liquids, such as a planarizing liquid 141. In one embodiment, the liquid trap 124 may include a vertical bend in each arm 131 and a vertical collection tube 132 at the low point of each bend. Liquid drawn into the vacuum passageway 123 will tend to settle in the collection tubes 132 under the force of gravity. A valve 125 may be positioned at the base of each of the collection tubes 132 to periodically drain the liquid collected in the liquid trap 124.

In other embodiments, other means may be used to separate liquid from the fluid drawn through the vacuum passageway 123. For example, the liquid trap 124 may be separate from the platen 120, as discussed in greater detail below with reference to FIG. 7, and/or the liquid trap may be integral with the vacuum source 170. In another embodiment (not shown), where the angular velocity of the platen 120 is relatively high, the liquid trap may be positioned toward the outer edge of the platen 120 and may take advantage of centrifugal forces to separate liquid from the fluid stream passing through the vacuum passageway 123. An advantage of the gravity-driven liquid trap 124 shown in FIG. 2 may be that it will continue to collect liquid when the platen 120 has stopped rotating.

A rotary drive 151 may be coupled to the platen 120 with a rotary drive shaft 153 to rotate the platen 120, as indicated by arrow A. The rotary drive shaft 153 may include a central passage 155 that extends from the vacuum passageway 123 to a non-rotating conduit 128. The conduit 128 is in turn coupled to the vacuum source 170. A rotating seal 126 may be coupled between the conduit 128 and the rotating drive shaft 153 to provide a gas-tight seal between the conduit and the drive shaft and maintain vacuum pressures in the vacuum passage 123 when the platen 120 rotates relative to the vacuum source 170.

The platen 120 may also be translated and/or oscillated by a linear drive 152 coupled to the platen with a linear drive shaft 154. In one embodiment, the linear drive shaft 154 may include telescoping segments 154*a* and 154*b*. In other embodiments, splines or other means may be used to transmit lateral motion from the fixed linear drive 152 to the platen 120. The conduit 128 may include a bellows section 133 that expands and contracts as the platen 120 moves laterally relative to the vacuum source 170. In other embodiments, other means may be used to couple the vacuum source 170 to the translating platen 120. For example, in one such embodiment (not shown), the conduit 128 may be coiled in the manner of a telephone cord to account for relative lateral motion between the platen 120 and the vacuum source 170.

The platen 120 may include a lip 121 that extends upwardly from the platen upper surface 130 to engage a side surface 146 of the polishing pad 140 and prevent the polishing pad from sliding off the platen 120 if the vacuum source 170 is deactivated while the platen 120 is in motion. The lip 121 may accordingly engage the entire side surface 146, as shown in FIG. 2, or a portion of the side surface 146. For example, the lip 121 may engage less than the fill height of the side surface 146, or may extend around less than the entire periphery of the polishing pad 140, so long as it engages enough of the side surface 146 to prevent the polishing pad 140 from sliding laterally off the platen 120. In other embodiments, other means may be used to restrict motion of the polishing pad 140 relative to the platen 120, as will be discussed in greater detail with reference to FIGS. 5 and 6.

In one embodiment, the polishing pad 140 may comprise a nonporous or nearly non-porous material that provides a gas-tight or nearly gas-tight seal with the platen upper surface 130 when a vacuum is drawn through the vacuum apertures 122. For example, the polishing pad 140 may comprise polymers such as polyurethane, or may comprise glass or other non-porous materials. In another embodiment, the polishing pad 140 may comprise porous materials, as will be discussed in greater detail below with reference to FIG. 5.

One advantage of the CMP apparatus 110 shown in FIGS. 2–3 is that the polishing pad 140 may be easily removed from the platen 120 when, for example, the polishing pad is replaced due to normal wear or for other reasons. To replace the polishing pad 140, the vacuum source 170 is deactivated or otherwise decoupled from the platen 120, the polishing pad 140 is lifted from the platen, and a new polishing pad is positioned in its place. The entire operation may be completed in a relatively short period of time. By contrast, it may take a substantially longer period of time to detach a conventional, adhesively bonded polishing pad from the platen 120, remove any remaining adhesive from the platen, and adhesively bond a replacement polishing pad to the platen.

Another advantage of the CMP apparatus 110 shown in FIGS. 2–3 is that the vacuum source 170 may be deactivated when the polishing pad 140 is not in use and may be subsequently reactivated without affecting the bonding force between the polishing pad 140 and the platen 120. By contrast, the adhesives that may be used in conventional installations to bond the polishing pad 140 to the platen 120 may degrade over time, causing the bond between the polishing pad and the platen to fail.

Figure 4:
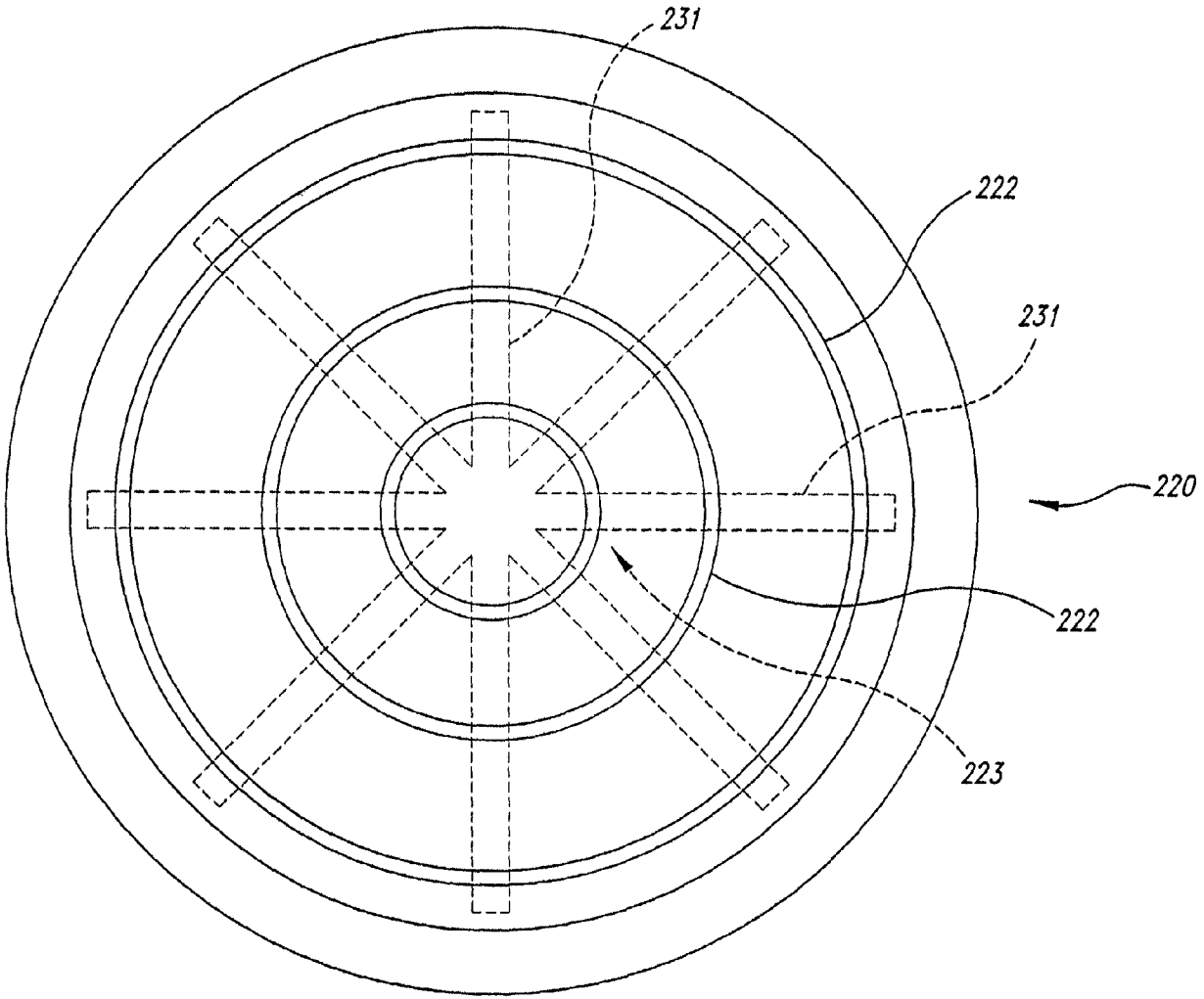
FIG. 4 is a top plan view of a platen having vacuum apertures in accordance with another embodiment of the invention.

FIG. 4 is a top plan view of a platen 220 having concentric, arcuate vacuum apertures 222. Each vacuum aperture 222 is in fluid communication with the arms 231 of the vacuum passageway 223, as was discussed above with reference to FIG. 2. An advantage of the arcuate vacuum apertures 222 when compared with the vacuum apertures 122 shown in FIGS. 2–3 is that the arcuate vacuum apertures may have a greater tendency to prevent the polishing pad 140 from wrinkling in the radial direction. Conversely, an advantage of the platen 120 having the vacuum apertures 122 shown in FIGS. 2–3 is that it may be simpler and less expensive to manufacture.

Figure 5A:
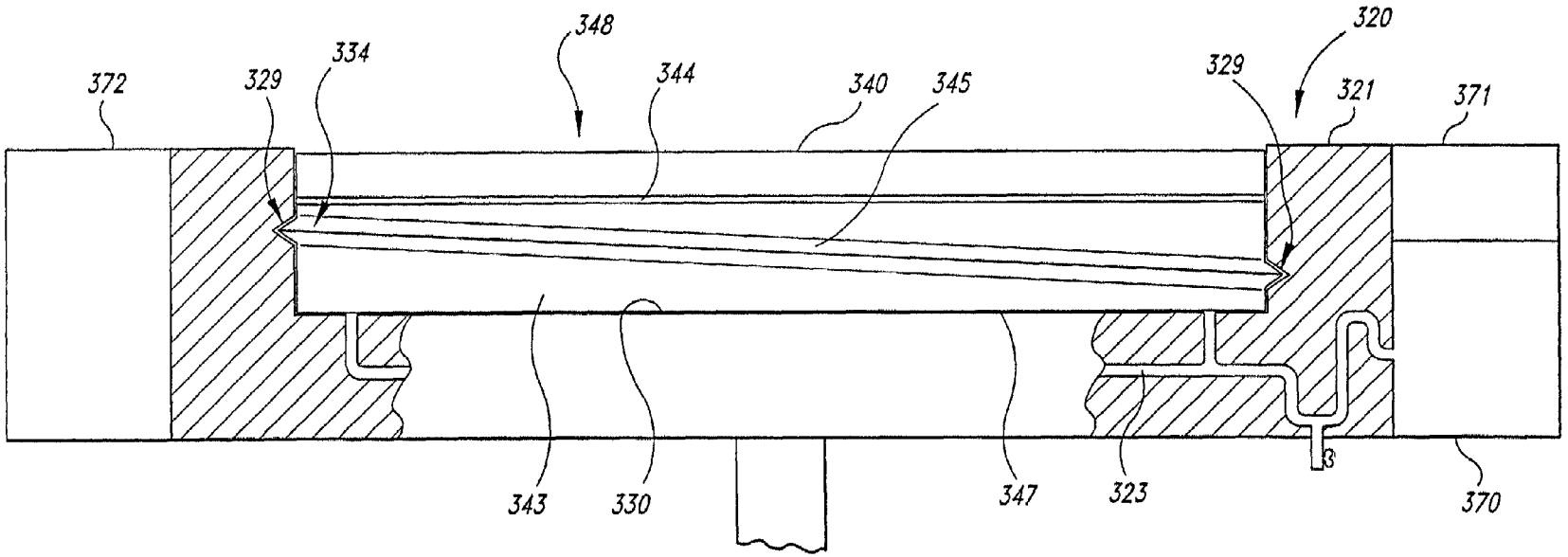
FIG. 5A is a partial cross-sectional elevation view of a platen having a locking device in accordance with yet another embodiment of the invention.

FIG. 5A is a partial cross-sectional side elevation view of a platen 320 having a vacuum source 370 attached thereto. The vacuum source 370 is accordingly coupled to the vacuum passageway 323 without the need for intervening conduits and rotating and/or translating gas-tight seals. In the embodiment shown in FIG. 5A, a power supply 371 is attached to the platen 320 and coupled to the vacuum source 370 to provide power to the vacuum source. The power supply 371 may include a battery, a solar panel, or other known devices that may supply power to the vacuum source 370 during planarization without the need for external connections. In another embodiment (not shown), the power supply 371 may be positioned apart from the platen 320 and may be coupled to the vacuum source 370 with slip rings or other rotating electrical connections.

In one embodiment, the vacuum source 370 and the power supply 371 may be relatively light in weight to reduce the power required by the platen drive assembly 150 (FIG. 2) to translate and/or rotate the platen 320. The platen 320 may also include a counterweight 372 positioned opposite the vacuum source 370 and the power supply 371 to balance the platen and reduce the likelihood that the platen will vibrate when it rotates. The counterweight 372 may comprise a simple dead weight or may comprise a functioning component of the platen 320, as is discussed in greater detail below with reference to FIG. 6.

An advantage of the vacuum source 370 and the power supply 371 shown in FIG. 5A is that they may eliminate the need for rotating and/or translating seals and electrical connections, as discussed above, and may accordingly simplify the construction and maintenance of the platen 320. Conversely, an advantage of the stationary vacuum source 170 shown in FIG. 2 is that it may include an existing commercially available device that need not be balanced and/or selected for low weight.

As shown in FIG. 5A, the planarizing medium 348 may include a polishing pad 340 attached to a pad support disk 343. The pad support disk 343 may have a generally non-porous attachment surface 347 that forms a gas-tight or nearly gas-tight seal with the platen upper surface 330. In the embodiment shown in FIG. 5A, the polishing pad 340 is attached to the pad support disk 343 with an adhesive 344 positioned therebetween. In other embodiments, other means are used to attach the polishing pad 340 to the pad support disk 343. Should it become necessary to replace the polishing pad 340, the polishing pad and the pad support disk 343 may be removed as a unit and replaced with a new planarizing medium 348.

In one embodiment, the entire planarizing medium 348 may be disposable. In another embodiment, the support disk 343 may be recycled by removing the old polishing pad 340 from the support disk and attaching a new polishing pad in its place. In either case, it may be advantageous to adhesively attach the polishing pad 340 to the pad support disk 343 rather than to adhesively attach the polishing pad to the platen 320 directly (as may be done conventionally) because the pad support disk 343 may be less costly than the platen. Accordingly, a large number of low-cost pad support disks 343 with polishing pads 340 attached may be kept on hand and available when needed. A further advantage is that the pad support disk 343 may be attached to a porous polishing pad 340, so that even the porous polishing pad may be releasably attached to the platen 320 by applying a vacuum to the support disk 343.

As shown in FIG. 5A, the platen 320 may include a locking device or stop 334 in addition to the lip 321, to further resist relative lateral and/or vertical motion between the planarizing medium 348 and the platen 320. In one embodiment, the stop 334 includes a female thread 329 in the lip 321 that engages a corresponding male thread 345 in the pad support disk 343. In another embodiment, where the polishing pad 340 is sufficiently rigid, the male thread 345 may be positioned in the polishing pad 340, rather than in the support disk 343. Obviously, the positions of the male thread 345 and the female thread 329 may be interchanged without departing from the scope of the invention. In one aspect of the embodiment shown in FIG. 5A, the threads 345 and 329 loosely engage each other so as not to inhibit the action of the vacuum source 370 as it draws the pad assembly 348 against the platen 320. In another embodiment, the threads 345 and 329 can more tightly engage each other to still further resist relative motion between the planarizing medium 348 and the platen 320. In one aspect of this embodiment, the mechanical connection between the planarizing medium 348 and the platen 320 can be secure enough to eliminate the need for the vacuum source 370 and the vacuum passageway 323. An advantage of the stop 334 shown in FIG. 5A is that it may further decrease the likelihood that the polishing pad 340 will separate from the platen 320, either axially or laterally, if the vacuum source 370 is halted while the platen 320 is moving.

Figure 5B:
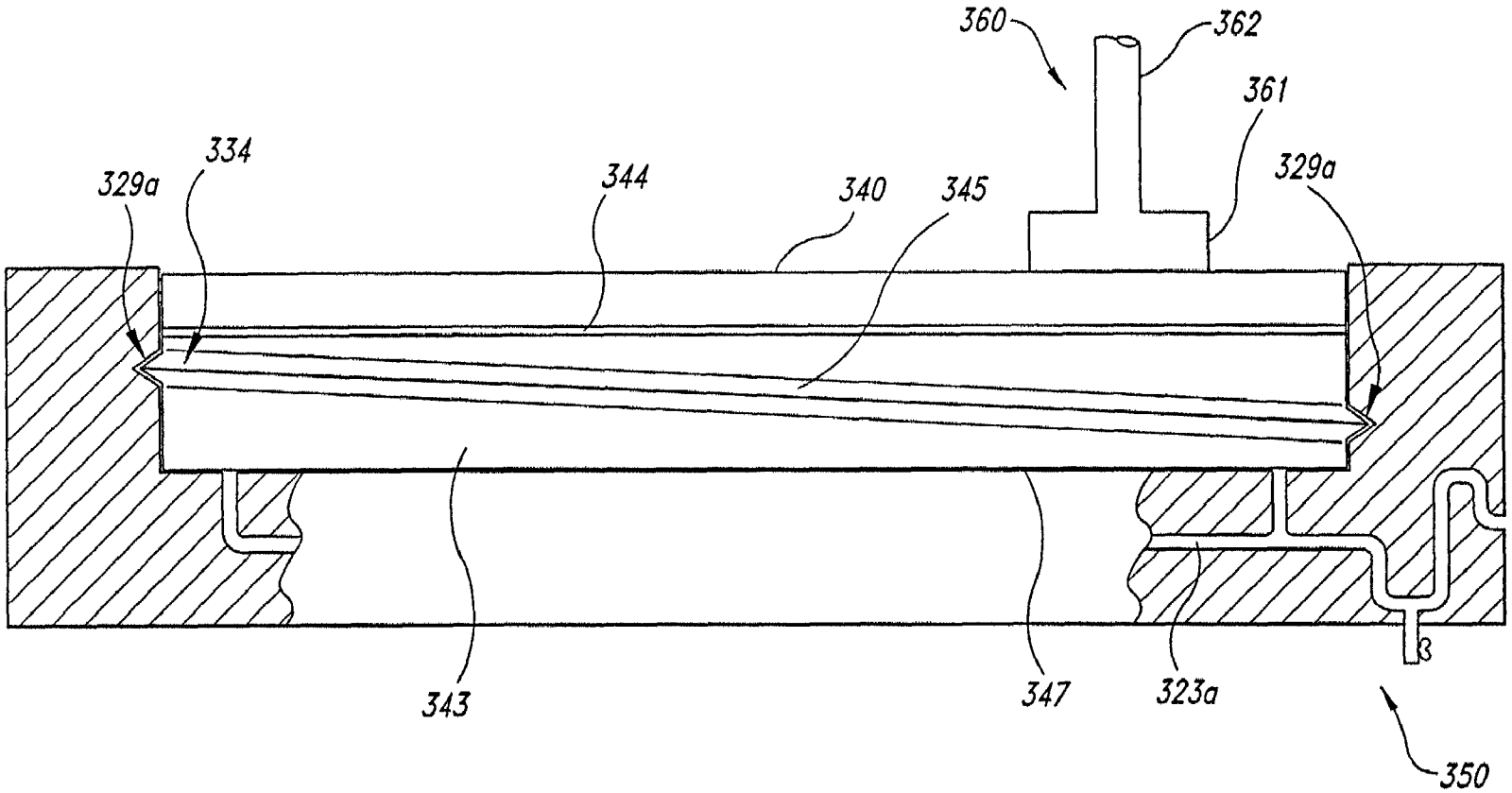
FIG. 5B is a partial cross-sectional elevation view of a jig used to support a platen in accordance with another embodiment of the invention.

FIG. 5B is a partial cross-sectional elevation view of a support jig 350 for supporting the polishing pad 340 and the support disk 343 during conditioning of the polishing pad 340. In one embodiment, the support jig 350 can include a vacuum passageway 323*a* coupled to a vacuum source 170 (FIG. 2) and/or a female thread 329*a* that engages the corresponding male thread 345 of the support disk 343. When the support jig 350 includes the vacuum passageway 323*a* to draw the support disk 343 toward the support jig 350, the support disk 343 can include a non-porous attachment surface 347. When the support jig 350 includes the female thread 329*a* to engage the support disk 343, the support disk 343 and male thread 345 can include a relatively rigid material, such as metal or hard plastic to engage the female thread 329*a*. In other embodiments, the support jig 350 can include any means for firmly supporting the polishing pad 340 and the support disk 343. For example, in one embodiment, the support jig 350 can include a planarizing machine, and in a specific aspect of this embodiment, a planarizing machine that is no longer suitable for planarization.

The support jig 350 can include a pad conditioner 360 for conditioning the polishing pad 340. In one embodiment, the pad conditioner 360 can include an end effector 361 coupled to a drive device 362 that moves the end effector in one or more directions relative to the polishing pad 340. In one aspect of this embodiment, the end effector 361 can have a diamond abrasive surface. Alternatively, the end effector 361 can include any surface or other means for removing material from the planarizing surface or otherwise conditioning the planarizing surface of the polishing pad 340.

An advantage of the support jig 350 and the pad conditioner 360 shown in FIG. 5B is that they allow the pad 340 to be conditioned without requiring a planarization machine. Accordingly, the polishing pad 340 can be conditioned at the same time the planarization machine (with a different polishing pad installed) is used to planarize microelectronic substrates. For example, a new polishing pad 340 typically requires conditioning during an initial "break-in" period to remove extraneous materials that may have been deposited on the polishing pad 340 during manufacture or shipment. The support jig 350 allows the break-in period to be completed without impacting the throughput of planarization machines such as the one shown in FIG. 2.

Figure 6:
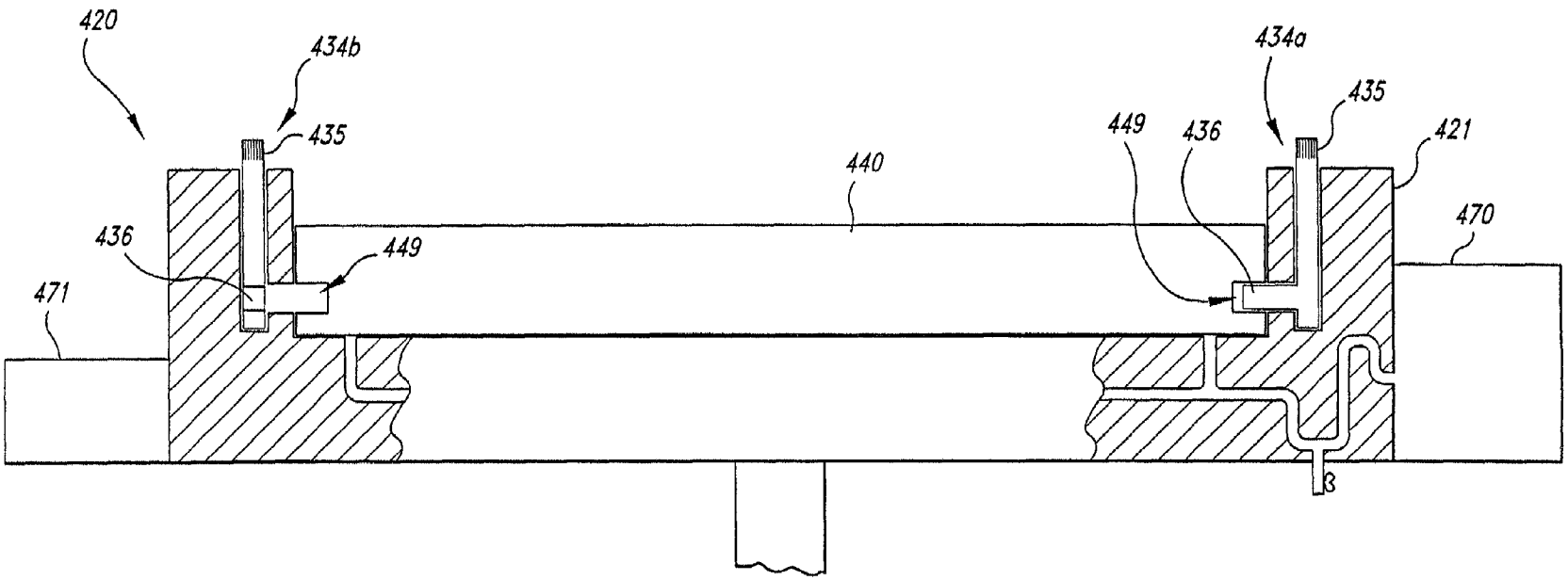
FIG. 6 is a partial cross-sectional elevation view of a platen having a locking device in accordance with still another embodiment of the invention.

FIG. 6 is a partial cross-sectional side elevation view of a platen 420 having two stops 434 (shown as 434*a* and 434*b*) in accordance with another embodiment of the invention. Each stop 434 may have a handle 435 that projects from an aperture in the lip 421, and a tab 436 toward the lower end of the handle 435. The tab 436 is sized and shaped to be received in a corresponding tab aperture 449 in the polishing pad 440. The stop 434 may be placed in an engaged position (as shown by the one stop 434*a*) by rotating the handle 435 until the tab 436 is within the corresponding tab aperture 449. The tab 436 may fit loosely within the tab aperture 449 to permit the vacuum source 470 to draw the planarizing medium 448 toward the platen 420, substantially as was discussed above with reference to FIG. 5. The stop 434 may be placed in a disengaged position (as shown by the other stop 434*b*) by rotating the handle 435 until the tab 436 is disengaged from the corresponding tab aperture 449, allowing the polishing pad 440 to be lifted from the platen 420.

As is also shown in FIG. 6, the vacuum source 470 may be positioned opposite the power supply 471 to balance the platen 420 when the platen rotates. In other embodiments, the power supply 471 may be positioned at other circumferential locations relative to the vacuum source 470, depending on the relative weights of the power supply and the vacuum source. In still other embodiments, other functional components of the platen 420 may be used in place of, or in addition to the power source 471 to balance the platen 420. An advantage of this arrangement is that it eliminates the need for the counterweight 372 (FIG. 5).

Figure 7A:
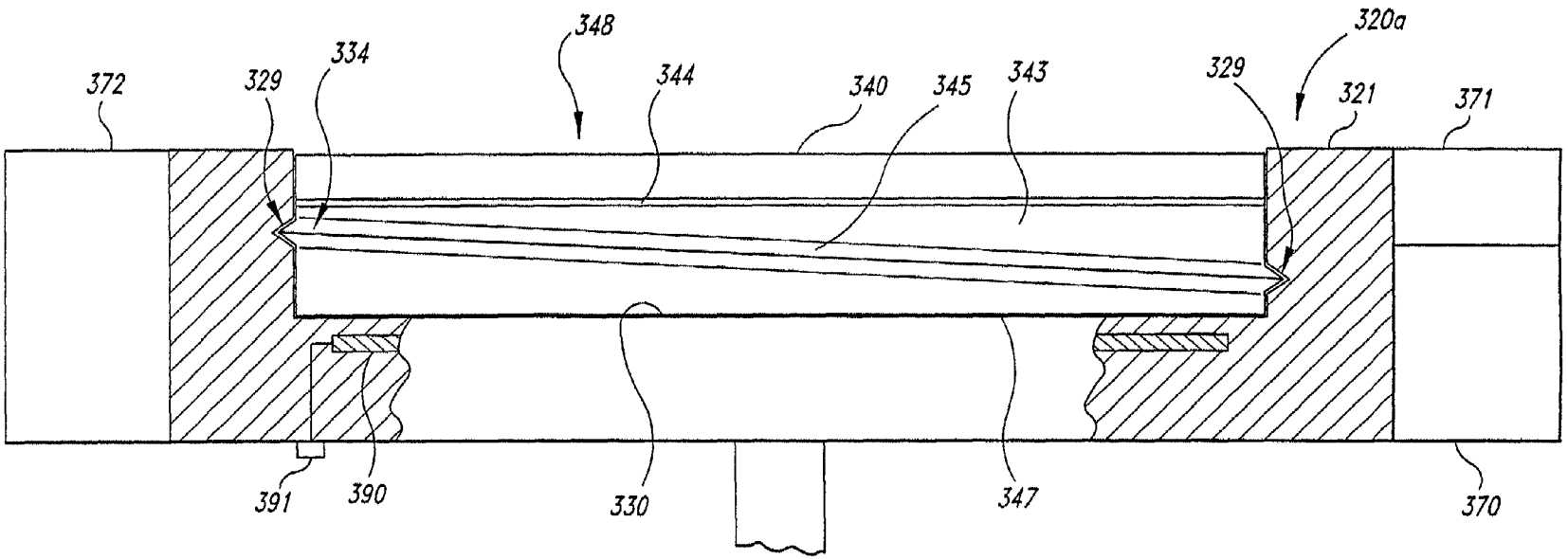
FIG. 7A is a partial cross-sectional elevation view of a platen having a plate to attract the pad support disk in accordance with still another embodiment of the invention.

FIG. 7A is a partial cross-sectional side elevation view of a platen 320*a* having a conductive plate 390 that draws the support disk 343 (with the polishing pad 340 attached) toward the platen upper surface 330 via electrostatic forces. As shown in FIG. 7A, the conductive plate 390 can be used in place of the vacuum systems discussed above with reference to FIGS. 2–6. In other embodiments, the conductive plate 390 can supplement a vacuum system such as one of the systems shown in FIGS. 2–6.

The conductive plate 390 can include any conductive material, such as aluminum or copper and can be charged by applying an electrical voltage to an electrode 391, which is electrically coupled to the conductive plate 390. The voltage on the conductive plate 390 can electrostatically attract the support disk 343, causing the support disk 343 to attach to the platen 320*a*. Any charge induced by the voltage can later be removed from the conductive plate 390 to detach the polishing pad 340.

In the embodiment shown in FIG. 7A, the support disk 343 can include the locking device 334 to further resist lateral and/or vertical motion between the polishing pad 340 and the platen 320*a*. In other embodiments, the locking device 334 can be eliminated. An advantage of the platen 320*a* shown in FIG. 7A is that it may be simpler to draw the polishing pad 340 and the support disk 343 toward the platen 320*a* with an electrostatic force than with other devices.

Figure 7B:
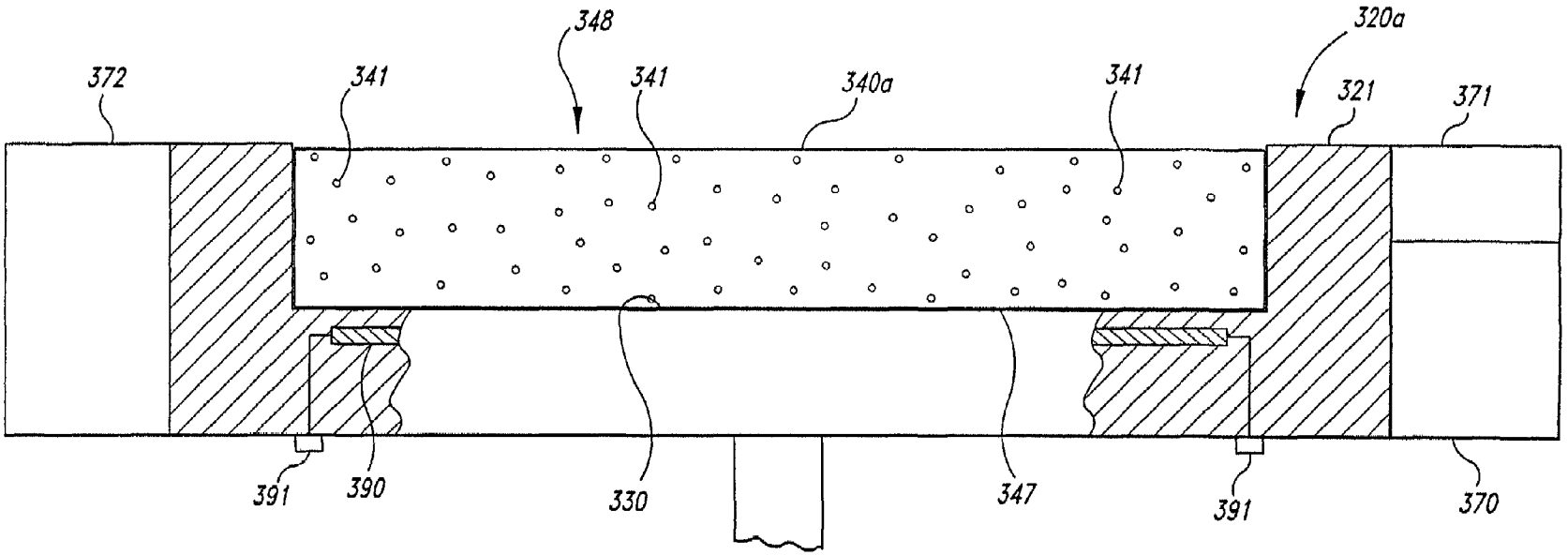
FIG. 7B is a partial cross-sectional elevation view of a platen having a plate to attract the polishing pad in accordance with yet another embodiment of the invention.

FIG. 7B is a partial cross-sectional view of a platen 320*b* with the conductive plate 390, and a polishing pad 340*a* having particles 341 distributed therein. The particles 341 can include a conductive material or any material capable of receiving an attractive force from the conductive plate 390 in a manner generally similar to that discussed above with reference to FIG. 7A. The particles 341 can also include a ferrous material so as to draw the polishing pad 340*a* toward the platen 320*b* via electromagnetic forces. Accordingly, the conductive plate 390 can include a pair of electrodes 391 for passing a current through the conductive plate 390. The particles 341 can be distributed in a generally uniform fashion, as shown in FIG. 7B, or the particles 341 can be concentrated near the attachment surface 347 of the polishing pad 340*a* to increase the effect of the force between the polishing pad 340*a* and the platen 320*a*.

Figure 8:
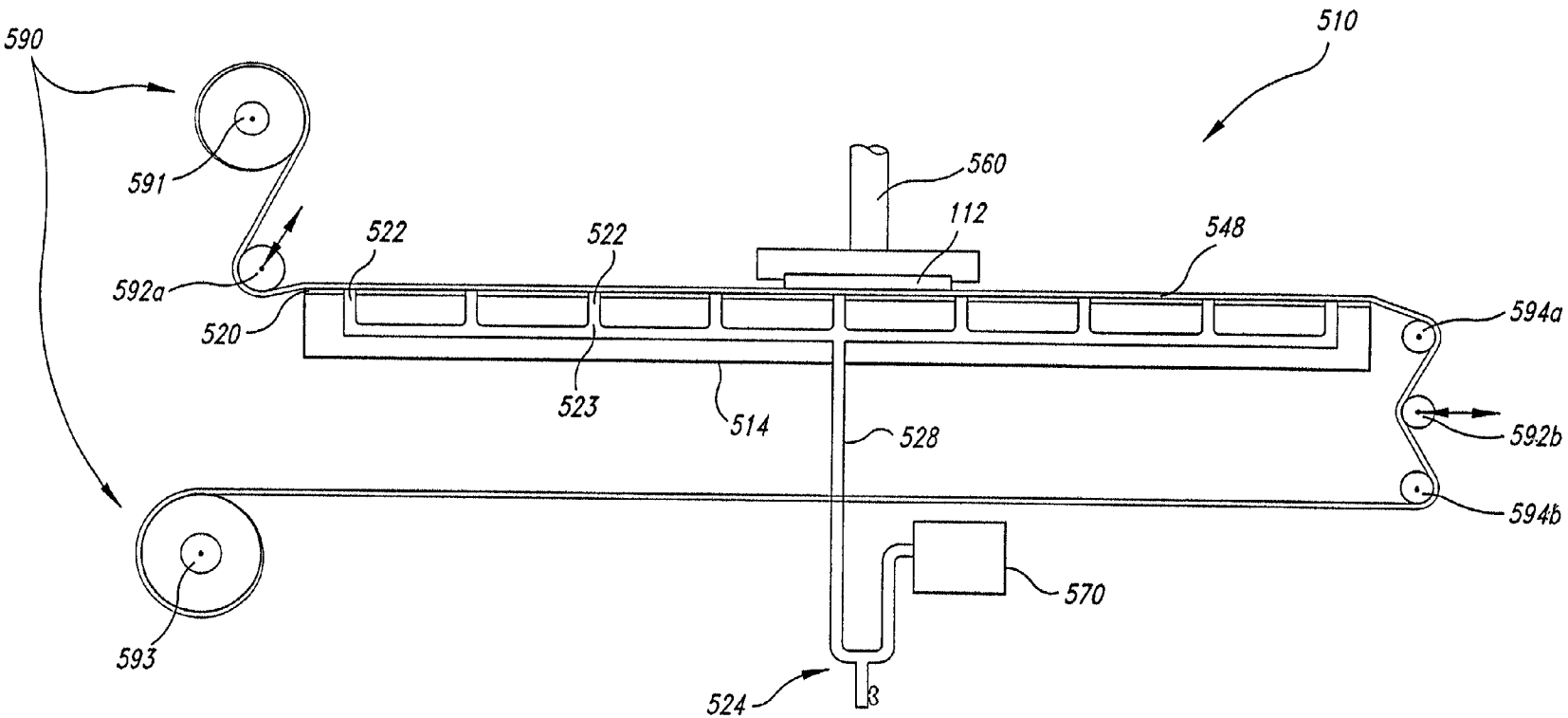
FIG. 8 is a partial cross-sectional elevation view of an apparatus having a supply device and a take-up device in accordance with still another embodiment of the invention.

FIG. 8 is a partial cross-sectional side elevation view of a CMP apparatus 510 having a planarizing medium 548 that translates relative to a fixed platen or base 520. The base 520 is supported by a support table 514 and generally includes a substantially incompressible material to provide a flat, solid surface to which the planarizing medium 548 may be secured during planarization. The CMP apparatus 510 further includes a positioning device 590 that draws the planarizing medium 548 over the base 520. In the embodiment shown in FIG. 7, the positioning device 590 includes a supply roller 591, first and second idler rollers 592*a* and 592*b*, first and second guide rollers 594*a* and 594*b*, and a take-up roller 593. The supply roller 591 carries an unused part of the planarizing medium 548, and the take-up roller 593 carries a used part of the planarizing medium 548. The supply roller 591 and/or the take-up roller 593 may be driven to sequentially advance unused portions of the planarizing medium 548 onto the base 520. As such, unused portions of the planarizing medium 548 may be quickly substituted for worn or used portions to provide a consistent surface for planarizing the substrate 112. In one embodiment, the first idler roller 592*a* and the first guide roller 594*a* position the planarizing medium 548 slightly below the base 520 so that the supply and take-up rollers 591 and 593 stretch the planarizing medium 548 across the base during planarization. In other embodiments, the planarizing medium 548 need not be stretched, as is discussed in greater detail below.

The base 520 includes a plurality of vacuum apertures 522 in fluid communication with a vacuum passageway 523. The vacuum apertures 522 may have a circular cross-sectional shape, as shown in FIG. 7, or may comprise slots or have other shapes in other embodiments. The vacuum passageway 523 is connected to a conduit 528 that is in turn coupled to the vacuum source 570, generally as was discussed above with reference to FIG. 2. In the embodiment shown in FIG. 7, a liquid trap 524 may be positioned in the conduit 528 and apart from the base 520 to separate liquid from the fluid drawn by the vacuum source 570. In another embodiment, the liquid trap 524 may form an integral component of the vacuum source 570.

In operation, the planarizing medium 548 is rolled up on the supply roller 591 and one end is stretched over the base 520 and attached to the take-up roller 593. The vacuum source 570 is activated to draw the planarizing medium 548 tightly against the base 520. A carrier assembly 560 is moved relative to the planarizing medium 548 to planarize the semiconductor substrate 112. Periodically, either during the planarization of a single semiconductor substrate 112, or after a semiconductor substrate has been planarized, the carrier assembly 560 may be halted, the vacuum source 570 deactivated, and the planarizing medium advanced slightly over the base 520 by rotating the take-up roller 593 and the supply roller 591. Once the planarizing medium 548 has been advanced by a selected amount, the vacuum source 570 may be reactivated, and planarizing may recommence.

In an alternative embodiment (not shown), the vacuum source 570 can be replaced with a voltage source to attract the planarizing medium toward the base 520 via electrostatic forces, in a manner generally similar to that discussed above with reference to FIGS. 7A–7B. In still a further alternative embodiment, the base 520 can include a permanent magnet or an electromagnet, as was discussed above with reference to FIG. 7B. It may be preferable to include an electromagnet rather than a permanent magnet to allow the magnet to be deactivated for advancing the planarizing medium 548 across the base 520. In either alternative embodiment, the planarizing medium 548 can include a conductive layer adjacent the base 520 in a manner generally similar to that shown in FIG. 7A. Alternatively, the planarizing medium 548 can include particles capable of receiving an induced electrostatic or electromagnetic force in a manner generally similar to that shown in FIG. 7B.

An advantage of the CMP apparatus 510 shown in FIG. 7 is that the suction force, electrostatic force or electromagnetic force may more securely engage the planarizing medium 548 with the platen 520 and may accordingly prevent the planarizing medium from wrinkling or folding when the semiconductor substrate 112 is planarized. A further advantage of the CMP apparatus 510 shown in FIG. 7 is that the planarizing medium 548 may be releasably attached to the platen 520 without the need for tensioning the planarizing medium. Accordingly, the planarizing medium 548 may be less likely to stretch or otherwise deform. Alternatively, the planarizing medium 548 may comprise a thinner, less costly sheet than is conventionally used because it does not need to withstand high tension forces.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method for removably attaching a planarizing medium to a platen of a planarizing machine, comprising:

embedding a plurality of conductive particles in the planarizing medium; and applying a signal to the platen that produces an electromagnetic attractive force between the platen and the conductive particles in the planarizing medium.

2. The method of claim 1, further comprising positioning the platen adjacent to the planarizing medium.

3. The method of claim 1 wherein the platen includes a conductive plate positioned within the platen, and applying a signal includes applying a signal to the conductive plate positioned within the platen.

4. The method of claim 1 wherein embedding a plurality of conductive particles further comprises embedding the plurality of conductive particles uniformly in the planarizing medium.

5. The method of claim 2 wherein embedding a plurality of conductive particles further comprises concentrating the plurality of conductive particles in a portion of the planarizing medium adjacent to the platen.

6. The method of claim 1 wherein embedding a plurality of conductive particles further comprises embedding a plurality of particles in the planarizing medium that are comprised of a ferrous material.

7. The method of claim 1, wherein applying a signal includes applying a current to the platen.

8. A method for releasably attaching a planarizing medium to a platen of a planarization machine, comprising:

providing the planarizing medium having a plurality of conductive particles embedded therein;

positioning the planarization medium adjacent to the platen; and coupling a signal to the platen to produce an electromagnetic attractive force between the conductive particles and the platen.

9. The method of claim 8, wherein the planarizing medium includes an attachment surface having a concentration of conductive particles located proximate to the attachment surface, and positioning the planarizing medium is further comprised of positioning the attachment surface on the platen.

10. The method of claim 8, wherein the platen includes a conductive member positioned within the platen, and coupling a signal to the platen further comprises coupling a signal to the conductive member.

11. The method of claim 8, wherein coupling a signal includes coupling a current to the platen.

12. The method of claim 8, wherein the plurality of conductive particles are uniformly distributed in the planarizing medium.

13. The method of claim 8, wherein the plurality of conductive particles are concentrated in a portion of the planarizing medium adjacent the platen.

* * * * *